United States Patent [19]

Brown

[11] Patent Number: 4,969,316

[45] Date of Patent: Nov. 13, 1990

[54] SAFETY STIRRUP

[76] Inventor: Roy L. Brown, Brown's Performance Saddles, Rte. 2, Box 132, Nevada, Mo. 64772

[21] Appl. No.: 310,769

[22] Filed: Feb. 14, 1989

[51] Int. Cl.[5] ..... B68C 3/02

[52] U.S. Cl. ..... 54/49

[58] Field of Search ..... 54/47, 48, 49

[56] References Cited

U.S. PATENT DOCUMENTS

| | | | |
|---|---|---|---|
| 23,572 | 4/1859 | Hamersley | 54/48 |
| 107,448 | 9/1913 | Ward | 54/49 |
| 215,942 | 5/1879 | de La Nux | 54/49 |
| 367,696 | 8/1887 | Bull | 54/48 X |
| 478,633 | 7/1892 | Peacock | 54/49 |
| 4,281,503 | 8/1981 | Teel | 54/49 |

*Primary Examiner*—Robert P. Swiatek

*Attorney, Agent, or Firm*—Hovey, Williams, Timmons & Collins

[57] ABSTRACT

An improved, low-cost safety stirrup (10) is provided having a release feature which permits safe removal of a rider's foot 26 in the vent of a fall or other mishap, and which also includes a shock-absorbing mechanism (15) and anti-rotation structure (31, 44) for preventing undesirable stirrup turning. The stirrup (10) advantageously includes a unitary metallic frame (12) presenting a tubular upper end (28) and a cantilever, footpad-supporting lower base (40). A footpad assembly (16) including a resilient, synthetic resin, U-shaped member, presenting at its bight, a footpad (56) is removably affixed to the frame base (40). An inboard keeper wall (58) extends upwardly from the footpad (56) to prevent escape of the rider's foot (26) during normal riding, but yields and bends open to permit the rider's foot (26) to clear the stirrup (10) in the event of a fall or the like. The shock-absorbing mechanism (15) includes a saddle strap loop (42) having a depending shank (44) slidably positioned within the upper end (28) of the frame (12), with a coil spring (46) encircling the shank (44). The shank (44) and a portion (31) of the frame bore (30) are polygonal in cross section whereby relative rotation between the loop (42) and frame (12) is prevented.

5 Claims, 1 Drawing Sheet

SAFETY STIRRUP

BACKGROUND OF THE INVENTION

1. Field of the Invention

This invention relates to a stirrup for a horse saddle incorporating safety features, a shock-absorbing assembly, and anti-rotation structure preventing undesirable stirrup rotation. More particularly, it is concerned with a stirrup having a unitary metallic frame with a cantilever base supporting a footpad assembly having a resilient synthetic resin keeper wall, which is openable to permit escape of a rider's foot in the event of a fall or other riding mishap; the stirrup also has a spring loaded shock-absorber assembly adjacent its upper end, which includes a complementally polygonal shaft and bore arrangement preventing undesirable stirrup rotation.

2. Description of the Prior Art

A major hazard in horseback riding is catching one's foot in the saddle stirrup in the course of an accidental fall or other mishap. Conventional stirrups offer adequate security for keeping the rider's foot within the stirrup during normal riding; however that same security poses a potential danger in a fall. The problem is to design a stirrup which provides adequate security for the foot during normal riding and yet is capable of releasing the foot in the event of an accident. This problem is compounded by the fact that most attempts at a solution employ some sort of mechanical break-away apparatus which is generally costly, unsightly, unstable, and difficult to reuse.

Another problem is the bodily shock experienced by both rider and horse in the course of normal riding. The physical weight of the rider is enhanced by the jostling and momentum accrued during riding. The problem is to provide adequate shock absorption to minimize the amount of shock to the rider's foot, as well as to the horse, while providing adequate support to make the foot effective in the riding process.

Another problem often experienced by rider is the rotation of the stirrup with respect to the saddle strap and/or the strap loop.

A number of modified stirrups have been developed in the past including those described in U.S. Pat. Nos. 23,572, 215,942, and 1,074,481.

SUMMARY OF THE INVENTION

The problems outlined above are solved by the safety stirrup in accordance with the present invention. That is to say, the safety stirrup operates to rapidly release a rider's foot in the case of an accident, while also absorbing shock in such a way as to provide adequate security for the foot yet enhance the comfort of the rider. The present invention also includes means for preventing rotation of the stirrup during riding.

The safety stirrup in accordance with the present invention broadly includes a frame having an upper end adapted for receiving a saddle strap and a lower, generally horizontal cantilever base presenting a free end. A footpad assembly including a resilient, synthetic resin, upstanding keeper wall adjacent and extending upwardly from the region of the base free end is affixed to the base for permitting the rider's foot to safely move out of the stirrup. A strap-receiving element, and structure securing the element to the upper end of the frame to prevent relative rotation between the frame and the element, is also provided.

In particularly preferred forms, the frame has structure defining an upright bore in the upper end thereof, and the strap-receiving element has an elongated shank disposed within the bore and a saddle strap loop adjacent the upper end of the shank. A coil spring is disposed about the shank within the bore and captively retained therein. A first pad and second pad are mounted on the footpad to enhance the shock absorbing features of the invention. Grease holes are also provided in the upper end of the frame for lubrication purposes.

DESCRIPTION OF THE PREFERRED EMBODIMENT

Figure 1:
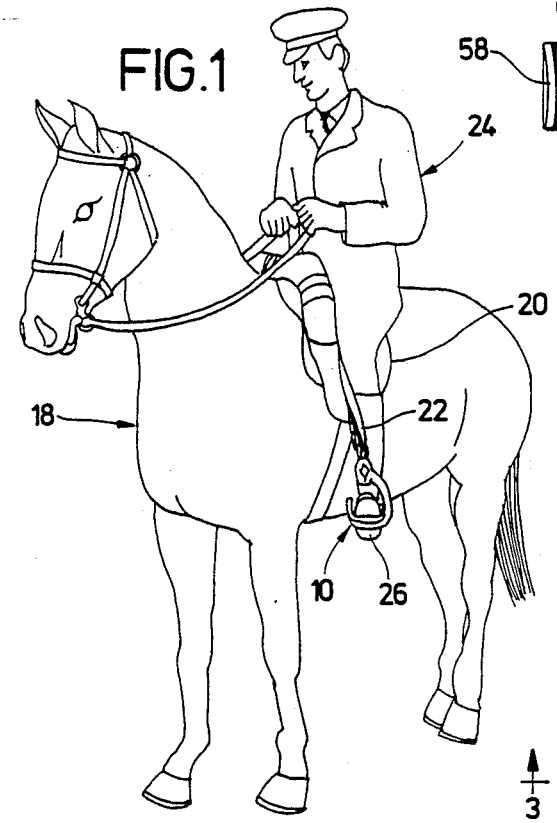
FIG. 1 is a perspective view of a horse and rider utilizing the safety stirrup in accordance with the present invention.
Figure 5:
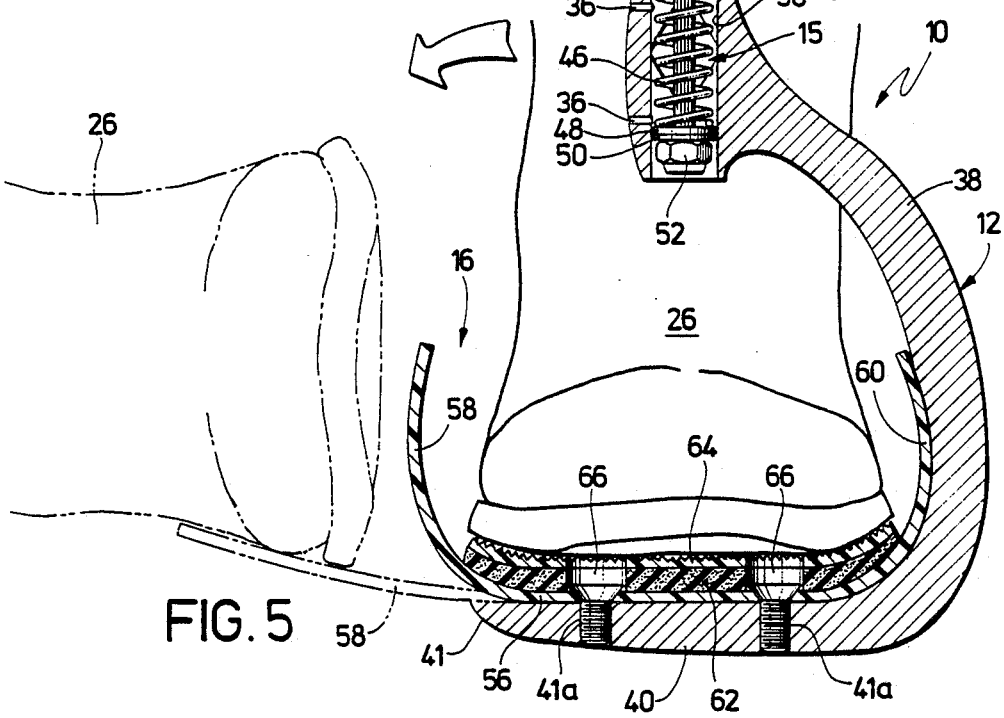
FIG. 5 is a vertical sectional view of the rider's foot mounted in the safety stirrup with the release action of the stirrup being depicted in phantom.

Referring now to the drawing in general and FIG. 5 in particular, a safety stirrup 10 in accordance with the invention broadly includes a metallic (e.g. an aluminum-magnesium alloy which bends rather than breaks at its yield point) frame 12, strap-receiving element 14, a shock absorbing assembly 15, and a footpad assembly 16. Referring to FIG. 1, a horse 18 is depicted wearing a saddle 20 having a saddle strap 22 which supports the stirrup 10. A rider 24 is mounted on the horse 18 and saddle 20 with the rider's foot 26 disposed within the stirrup 10.

Referring again to FIG. 5, frame 12 includes an upper end 28 having a vertical, stepped bore 30 therethrough, with the diameter of the bore 30 being enlarged at its lower end. The bore 30 also includes a square in cross section upper portion 31, terminating in an uppermost square aperture 32, whereas the lower enlarged bore portion terminates in an upper, internal shoulder 34. Two grease holes 36 provide access from the exterior of the upper end 28 to the bore 30.

Frame 12 also has a support portion 38 of arcuate configuration which generally depends from the upper end 28. The support portion 38 connects the upper end 28 with a lowermost cantilever base 40 of the frame 12.

Cantilever base 40 is substantially horizontal and has a free end 41 providing sufficient space to permit placement of rider's foot 26 thereabove. The base 40 also has a pair of threaded bores **41*a* therethrough, as best seen in FIG. 5**.

Strap-receiving element 14 includes a saddle strap loop 42 and an elongated, square in cross section shank 44. As will be seen, the shank 44 is received within bore 30 of frame end 28, with the cross-sections of the shank 44 and upper bore portion 31 being complemental.

The assembly 15 includes a coil spring 46 disposed about shank 44 within the enlarged lower end of bore 30. The upper end of spring 46 abuts shoulder 34, and is retained by means of a nylon washer 48, stainless steel washer 50, and nut 52 threaded onto the lower end of the shank 44.

Footpad assembly 16 includes an integral, U-shaped member presenting, at its bight, a footpad 56 having an upright keeper wall 58 and an opposed support wall 60 at opposite ends thereof. Footpad 56 rests on base 40. Keeper wall 58 extends upwardly from footpad 56 on the inboard side of stirrup 10, adjacent free end 41 of the base 40. Support wall 60 extends upwardly from footpad 56, substantially parallel with keeper wall 58 and on the outboard side of stirrup 10. The U-shaped member is constructed of any suitable resilient synthetic resin material, preferably a synthetic resin with memory. For example, the member can be constructed from "Kydex" plastic manufactured by the General Electric Corporation. The Kydex plastic is stamped cold, the sheet being heated to about 220° F. on an oven or hotplate for forming.

Figure 2:
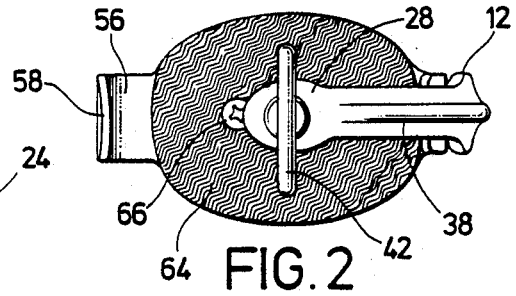
FIG. 2 is a plan view of the safety stirrup.
Figure 3:
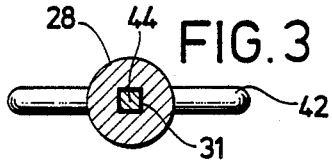
FIG. 3 is a vertical sectional view taken along line 3—3 of FIG. 5.
Figure 4:
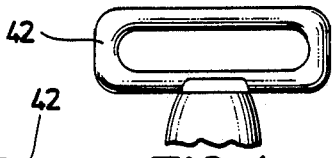
FIG. 4 is a fragmentary view of a saddle strap loop and the upper end of the stirrup frame.

Footpad assembly 16 further includes a first pad 62, also made out of a synthetic resin, preferably neoprene foam. First pad 62 is mounted on footpad 56 and fixed permanently thereto, such as by a glue. A second pad 64 is mounted and affixed on first pad 62. Second pad 64 is likewise affixed by some appropriate means such as glue. Second pad 64 is also constructed of synthetic resin, preferably a soft nonskid vinyl. The upper surface of second pad 64 is roughened to enhance the nonskid qualities, as depicted in FIG. 2. First pad 62 and second pad 64 are further attached to footpad 56 and base 40 by screws 66 passing through the pads and received in the threaded bores 41*a*.

In the use of stirrup 10, saddle strap 22 is first threaded through loop 42, in order to fix the stirrup 10 in the saddle 20 in the normal fashion. During riding, feet 26 of the rider 24 are of course placed within the stirrups 10, as best seen in FIGS. 1 and 5. In this orientation, it will be observed that the upright keeper wall 58 serves to prevent unintended lateral movement of the rider's foot 26 out of the confines of the stirrup 10. However, in the event of the riding mishap where, for example, the rider 24 may fall from the horse 18, the stirrup 10 serves to safely permit escape of the rider's foot 26. As best seen in FIG. 5, the keeper wall 58, being formed of resilient synthetic resin material, effectively bends to the dotted line position, thereby allowing the rider's foot 26 to escape safely from the stirrup 10. The effective memory of the keeper wall 58 thereupon immediately causes it to return to its upright position, so that the stirrup 10 is not damaged due to this action.

It will also been seen that the safety stirrup 10 of the invention provides an effective shock-absorbing function. That is to say, during normal riding the rider 24 and horse 18 will experience jarrings and vibrations, and the assembly 15 serves to dampen and absorb such loadings. Specifically, the coil spring 46 absorbs normal shock loads other than submitting these to horse 18 and rider 24. As will be readily appreciated from a study of FIG. 5, during shock-absorbing operations the square shank 44 and frame end 28 can shift axially relative to each other, constrained by spring 46. However, relative rotation between the shank 44 and frame portion 28 is precluded, by virtue of the complemental square-in cross section configuration of the shank and proportion 31. As a consequence, axial rotation of the stirrup 10 is inhibited.

In actual practice, the footpad assembly 16 of the present invention may be constructed in various ways, in order to conform to the desires of the manufacturer. However, it has been found advisable to construct this assembly so that a force of at least about 11 to 18 pounds is required to move keeper wall 58 from its normal upright position to the lowered escape position depicted in phantom in FIG. 5. Actual measurements indicate that a force of 15 pounds is required to outwardly deform keeper wall 58 to an escape position at 45° to the horizontal axis.

What is claimed is:

1. A safety stirrup adapted to be attached to a saddle strap and receive a rider's foot, said stirrup comprising:

a frame having an upper end adapted for receiving said strap and a lower, generally horizontal cantilever base having a lateral dimension and presenting a free end spaced below said upper end, and a single, depending wall portion interconnecting said upper end and base, the spacing between said upper end and base end being sufficient to permit placement of a rider's foot above the base, said upper end being located substantially centrally of said base substantially at the lateral midpoint thereof; and a footpad assembly affixed to said base and including a resilient, synthetic resin, normally upstanding keeper wall adjacent and extending upwardly from the region of said base free end, said keeper wall permitting substantially unrestricted up and down movement of the rider's foot within the stirrup, said keeper wall being deformable outwardly under the influence of excessive force applied thereagainst by the rider's foot, in order to permit the rider's foot to safely move out of the stirrup, said keeper wall having memory sufficient for causing the keeper wall to reassume the normal upstanding orientation thereof after said rider's foot has cleared the stirrup, without manual manipulation of the keeper wall.

2. The stirrup of claim 1, said keeper wall being formed of material requiring a force of at least about 11 to 18 pounds to deform outwardly.

3. The stirrup of claim 1, including means for removably affixing said footpad assembly to said base.

4. The stirrup of claim 3, further comprising:

means for absorbing the shock of the rider's foot against said footpad assembly.

5. The stirrup of claim 4, said shock absorber means comprising:

structure defining an upright bore in the upper end of said frame;

a strap-receiving element having an elongated shank within said bore, and a saddle strap loop adjacent the upper end of the shank, said shank and structure being relatively axially shiftable;

a coil spring disposed about said shank within said bore; and means for retaining said spring and shank within said bore.

* * * * *